US006095169A

United States Patent [19]

Lin et al.

[11] Patent Number: 6,095,169

[45] Date of Patent: Aug. 1, 2000

[54] AUTOMATIC UMBRELLA HAVING RIB ASSEMBLY FORMED WITH LIGHT GROOVED RIB REINFORCED RESILIENT RIB

[75] Inventors: Chung-Kuang Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/197,483

[22] Filed: Nov. 20, 1998

Related U.S. Application Data

[63] Continuation-in-part of application No. 09/001,515, Dec. 31, 1997, Pat. No. 5,931,175.

[51] Int. Cl.[7] ..... A45B 25/14

[52] U.S. Cl. ..... 135/31; 135/25.1; 135/25.32; 135/29; 135/32; 135/40

[58] Field of Search ..... 135/31, 25.1, 25.32, 135/29, 32, 40

[56] References Cited

U.S. PATENT DOCUMENTS

| | | | |
|---|---|---|---|
| Re. 21,492 | 6/1940 | Okun | 135/31 X |
| 498,665 | 5/1893 | Liley | 135/40 |
| 960,038 | 5/1910 | Peck | 135/29 |
| 2,177,458 | 10/1939 | Okun | 135/25 |
| 3,640,298 | 2/1972 | Weber | 135/25.1 |
| 5,263,505 | 11/1993 | Yeom | 135/29 X |

FOREIGN PATENT DOCUMENTS

| | | | |
|---|---|---|---|
| 2252040 | 12/1963 | United Kingdom | 135/29 |
| 943886 | 12/1963 | United Kingdom | 135/29 |

*Primary Examiner*—Carl D. Friedman
*Assistant Examiner*—Phi Dieu Tran A

[57] ABSTRACT

An automatic umbrella includes: a top rib and a stretcher rib each having a cross section of U shape or the like shape and made of light material including aluminum alloy, an outer rib gradually tapered outwardly and an auxiliary stretcher rib each having a cross section of circular shape or the like shape and made of composite or plastic materials having good resilience and mechanical strength to be respectively connected with the top rib and the stretcher rib, a flattened tensioning spring jacketed on the shaft and retained between a middle runner arid a lower runner having a cross section of the spring ring formed as rectangular shape for forming a slim umbrella shaft, and a top cap member firmly fixed on a top of the shaft, thereby providing an automatic umbrella having light weight, better resilience and strength, slim structure, and firmly fastened top cap.

8 Claims, 8 Drawing Sheets

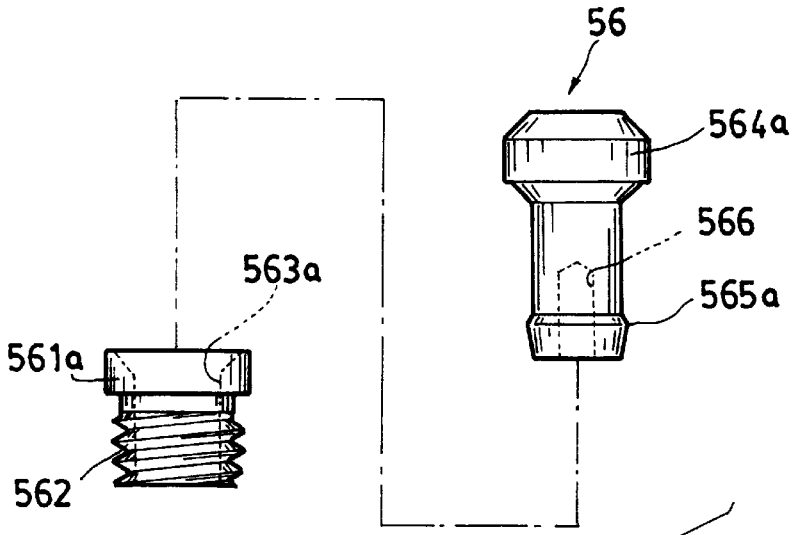
FIG. 6a
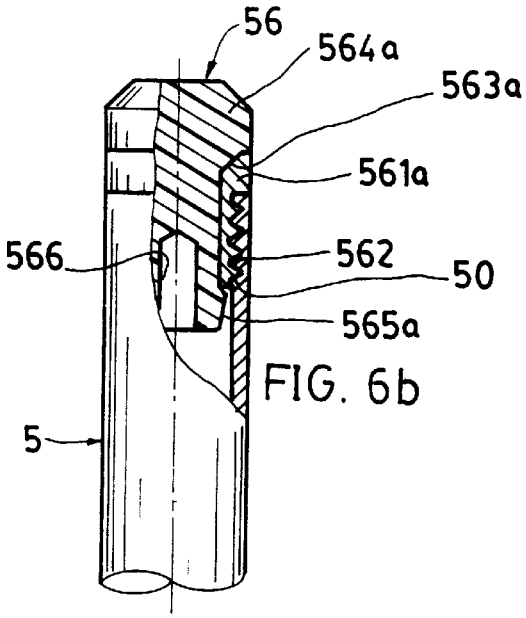
FIG. 6b
FIG. 6c
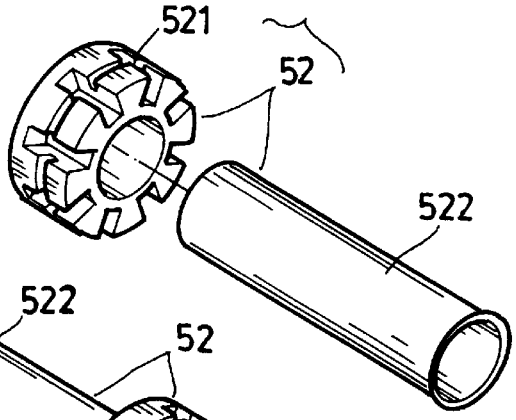
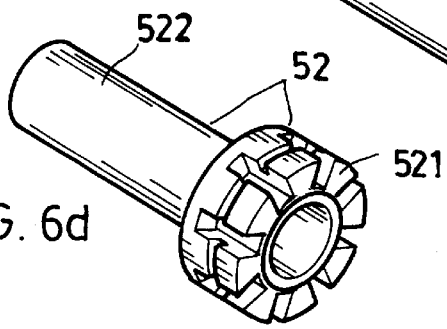
FIG. 6d

AUTOMATIC UMBRELLA HAVING RIB ASSEMBLY FORMED WITH LIGHT GROOVED RIB REINFORCED RESILIENT RIB

This application is a continuation-in-part (C-I-P) of U.S. patent application (or parent application) filed by the inventors on: Dec. 31, 1997 with Ser. No. 09/001,515, now U.S. Pat. No. 5,931,175.

BACKGROUND OF THE INVENTION

The parent application did not disclose an automatic umbrella having proper elements and mechanism for both light weight and resilient performance.

Accordingly, this application provides further elements and modifications in addition to the light and resilient rib assembly of the parent application to form an automatic umbrella lightly carried and resiliently operated.

SUMMARY OF THE INVENTION

The object of the present invention is to provide an automatic umbrella including: a top rib and a stretcher rib each having a cross section of U shape or the like shape and made of light material including aluminum alloy, an outer rib gradually tapered outwardly and an auxiliary stretcher rib each having a cross section of circular shape or the like shape and made of composite or plastic materials having good resilience and mechanical strength to be respectively connected with the top rib and the stretcher rib, a flattened tensioning spring jacketed on the shaft and retained between a middle runner and a lower runner having a cross section of the spring ring formed as rectangular shape for forming a slim umbrella shaft, and a top cap member firmly fixed on a top of the shaft, thereby providing an automatic umbrella having light weight, better resilience and strength, slim structure, and firmly fastened top cap.

BRIEF DESCRIPTION OF THE DRAWINGS

FIG. 6*a* shows another exploded top cap member of the present invention.

FIG. 6*b* is a partial sectional drawing of the top cap member as assembled from FIG. 6*a*.

FIG. 6*c* shows an exploded middle runner of the present invention.

FIG. 6*d* shows the middle runner as assembled from FIG. 6*c*.

DETAILED DESCRIPTION

Figure 1:
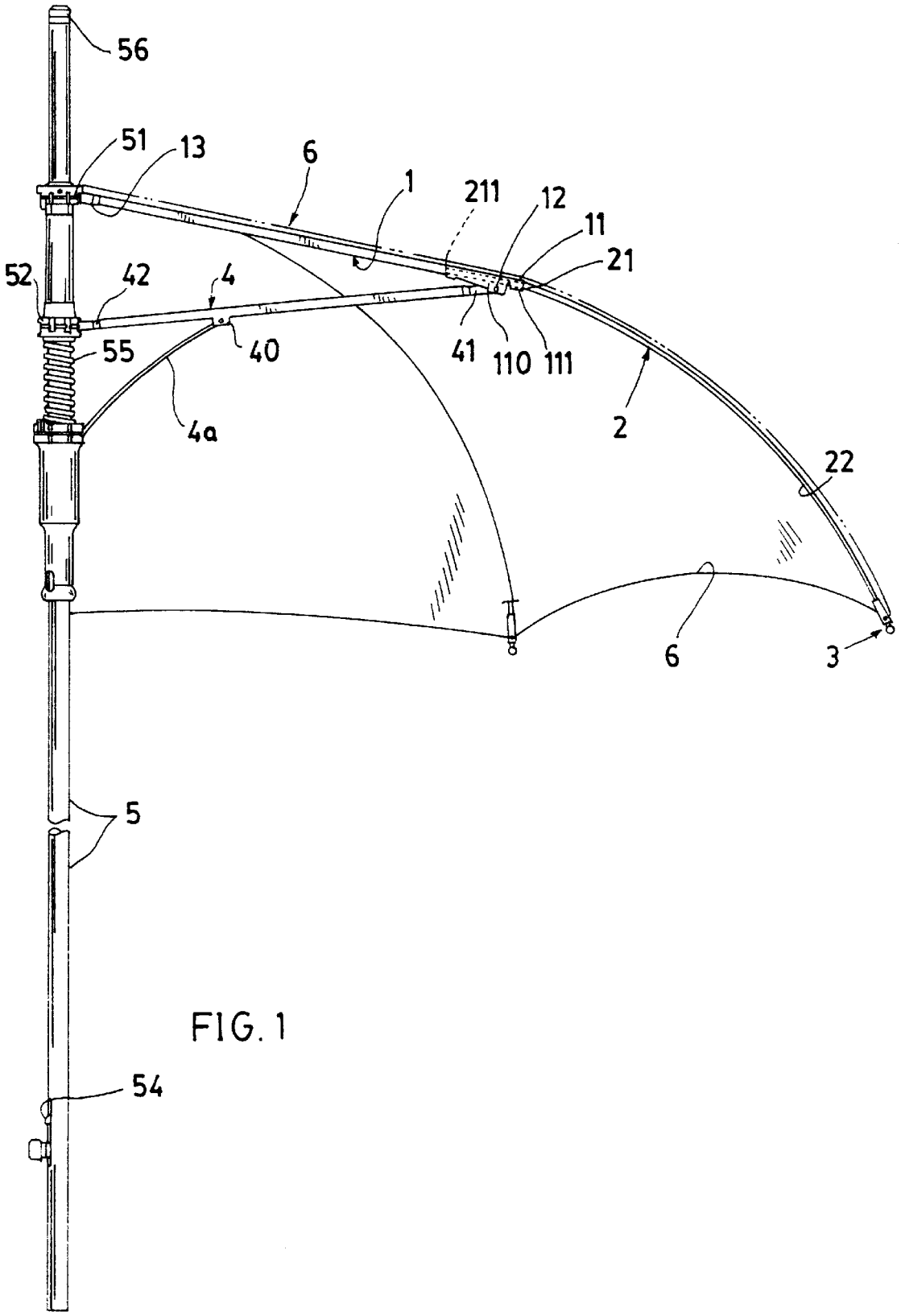
FIG. 1 shows an opened umbrella of the present invention.

As shown in FIGS. 1–8, the present invention comprises: an umbrella rib assembly including at least a top rib 1 pivotally connected to an upper notch 51 on an upper portion of a central shaft 5 and having a cross section of U shape or the like shape, an outer rib 2 having a cross section of circular shape or the like shape and connected to the top rib 1, a ball tip 3 connected with an outer end of the outer rib 2, a stretcher rib 4 pivotally connected between a middle runner 52 slidably held on the central shaft 5 and the top rib 1 adjacent to a joint between the top rib 1 and the outer rib 2, an auxiliary stretcher rib 4*a* pivotally connected between tie stretcher rib 4 and a lower runner 53 slidably held on the central shaft 5, a flattened tensioning spring 55 jacketed on the shaft and retained between the middle runner 52 and the lower runner 53 for opening the umbrella, a top cap member 56 firmly fastened on a top of the central shaft 5, and an umbrella cloth 6 secured on the top ribs 1 and the outer ribs 2 for covering the umbrella. The present invention may also be modified to be multiple folds such as two folds or triple folds of an umbrella, not limited in this invention.

The top rib 1 and the stretcher rib 4 may be made of light materials including aluminum alloy, titanium alloy, and other materials light in weight, suitable for mechanical processing, extrusion, pressing, compression and integral forming for making an U-shaped groove longitudinally recessed in the top rib 1 and the stretcher rib 4.

The outer rib 2 and the auxiliary stretcher rib 4*a* may be made of composites or plastic materials having properties such as good mechanical strength for resisting bending, deformation, or twisting and having good resilience. The materials for making the outer rib 2 and the auxiliary stretcher rib 4*a* may be selected from the group consisting of: carbon fiber, fiber-glass reinforced plastic, nylon, mineral-fiber reinforced composites, and the other reinforced composites, elastomers or engineering plastics. The rib 2, 4*a* may have a cross section of circular shape or other suitable shapes.

The top rib 1 includes an outer portion 11 having an outermost end portion 111 which is bifurcated to be two crimping lugs for cladding, surrounding or compressing an inner portion 21 of the outer rib 2, having a plurality of prongs, teeth, or protrusions 112 pressed inwardly from the top rib 1 into the inner portion 21 of the outer rib for firmly connecting the inner portion 21 of the outer rib 2 with the outer portion i1 of the top rib 1.

Figures 7, 8, 9:
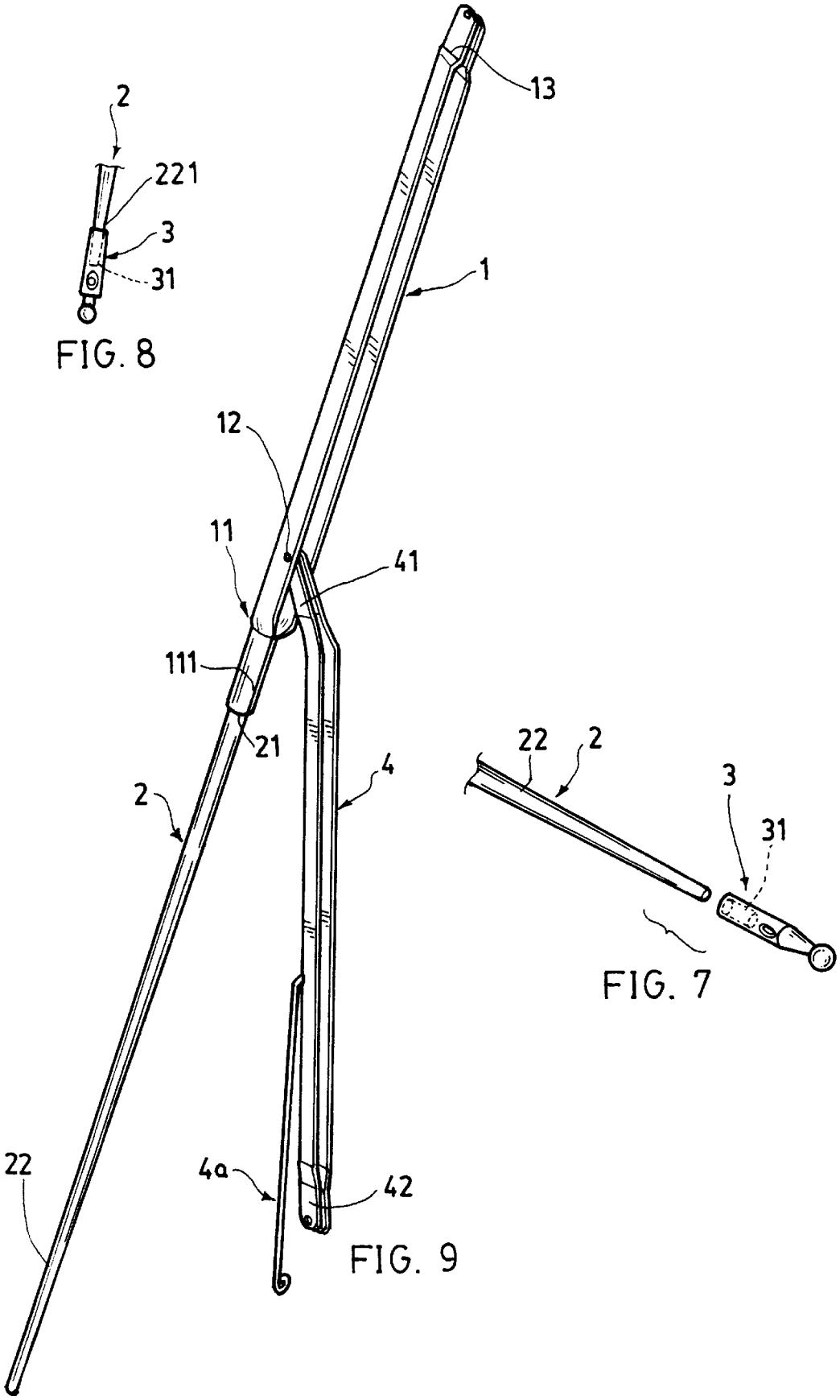
FIG. 7 shows the ball tip securable to the outer rib in accordance with the present invention.
FIG. 8 shows the ball tip as secured on the outer rib.
FIG. 9 shows another preferred embodiment of the rib assembly.

The outer rib 2 has its outer end portion 22 gradually tapered outwardly to be connected with a ball tip 3 which may be made of the same composite or plastic material as used for making the outer rib 2, or any other materials. The bail tip 3 is formed with a tubular hole 31 therein for squeezing and engaging the tapered end portion 22 of the outer rib 2 into the tubular hole 31 of the ball tip 3 for a firm connection of the ball tip 3 on each tapered end portion 22 as shown in FIGS. 2, 7 and 8.

Figure 2:
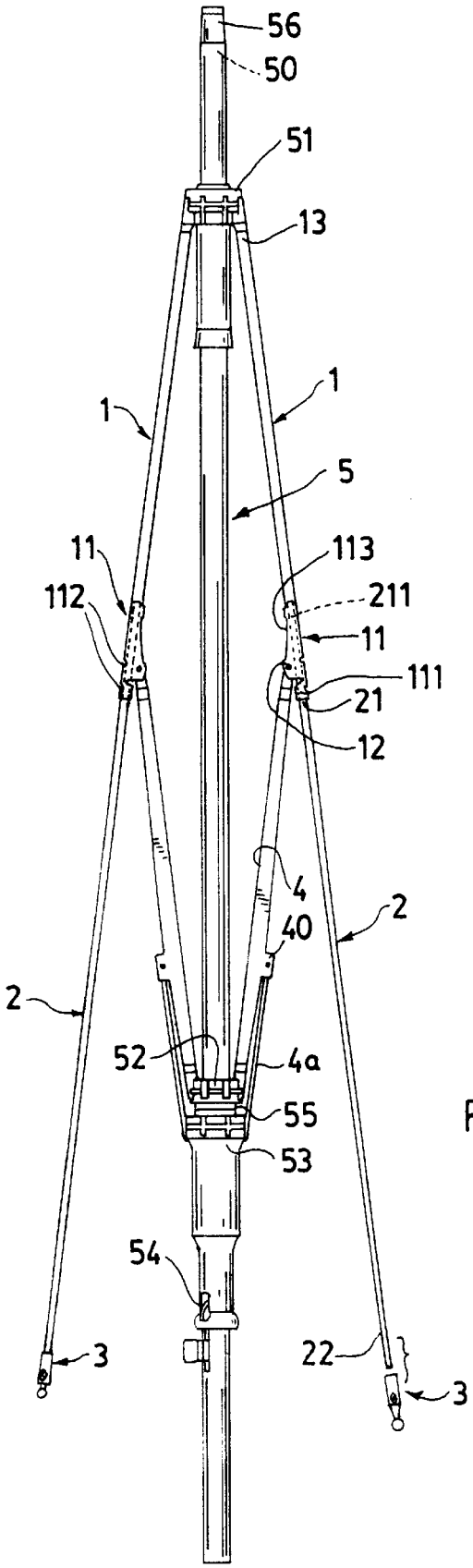
FIG. 2 shows a folded umbrella of the present invention.
Figure 3:
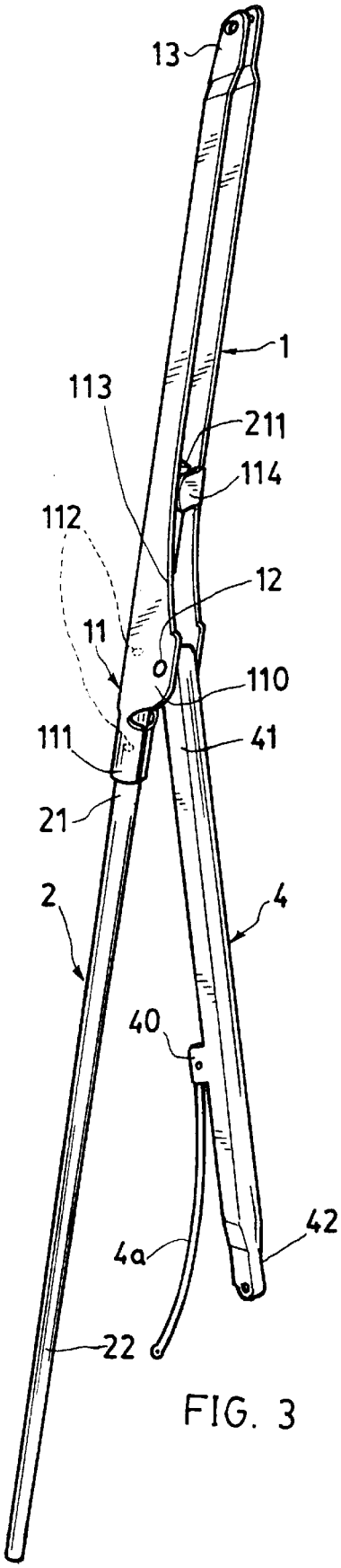
FIG. 3 is a perspective view of the rib assembly of the present invention.

As shown in FIGS. 1–3, the top rib 1 has its outer portion 11 formed with a pair of protrusion lugs 110 pivotally connected with an outer rib portion 41 of the stretcher rib 4 by a pivot 12; an inner end portion 13 of the top rib 1 pivotally secured to the upper notch 51 formed on an upper portion of the central shaft 5. The stretcher rib 4 has its inner rib portion 42 pivotally connected to the middle runner 52 slidably held on the central shaft 5, and the auxiliary stretcher rib 4*a* pivotally connected between the lower runner 53 and a pair of lugs 40 formed on the stretcher rib 4, whereby upon opening of the umbrella, the runner 53 will be stopped on the shaft 5 while the umbrella cloth 6 is extended by the rib assembly consisting of the top and outer ribs 1, 2 as shown in FIG. 1. Each protrusion lug 110 is tapered inwardly towards a middle portion of the top rib 1 for forming a reinforcing wing portion 113 between the lug 110 and the middle portion of the top rib 1, having a bottom extension 114 bent from the reinforcing wing portion 113 to be positioned at a bottom of the top rib 1 for cladding and limiting an innermost end 21i of the outer rib 2.

The auxiliary stretcher rib 4*a* is a slightly arcuate resilient rib retained between the lower runner 53 and the stretcher rib 4 (FIG. 1). Upon closing of the present invention, the rib assembly is folded and the lower runner 53 is locked on the shaft 5 by catch 54 as shown in FIG. 2 to straighten and tension the auxiliary stretcher rib 4*a* to store its resilience to thereby add on the resilience of the flattened tensioning spring 55 jacketed on the shaft 5 adapted for opening the umbrella. The resilience of the plural auxiliary stretcher ribs 4*a* may share the "main resilience" of the tensioning spring 55, thereby smoothly sharing a retraction force when closing the umbrella from FIG. 1 to FIG. 2.

Figure 4:
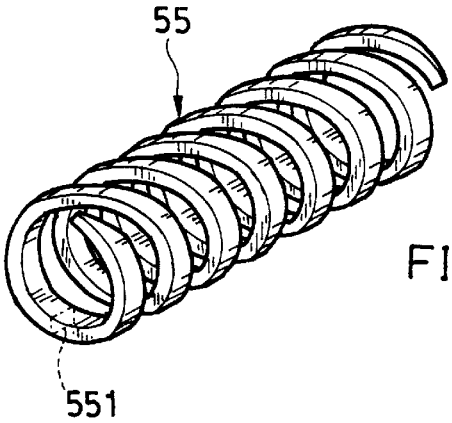
FIG. 4 shows the flattened tensioning spring of the present invention.
Figure 5:
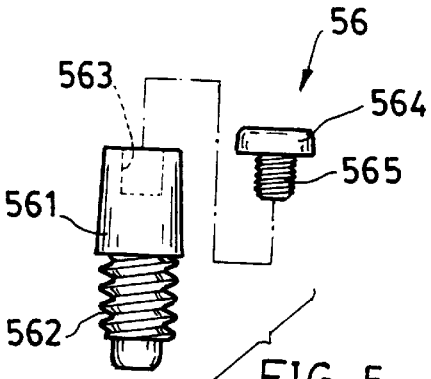
FIG. 5 shows the top cap member of the present invention.
Figure 6:
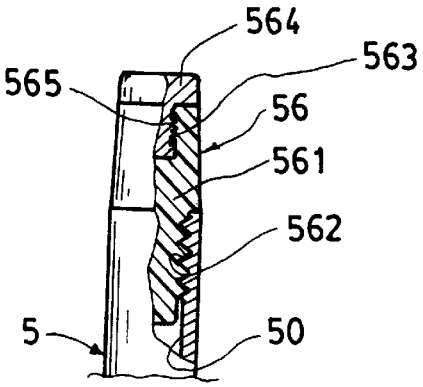
FIG. 6 is a partial sectional drawing of the top cap member.

As shown in FIGS. 4 and 1, the flattened tensioning spring 55 retained between the middle and lower runners 52, 53 includes a spring ring having a cross section 551 formed as a rectangular shape for minimizing the width of the tensioning spring 55 since the rectangular cross section of the spring ring can be narrower than the circular cross section of a conventional spring ring for making a slim structure of the present invention.

The top cap member 56 (FIGS. 5, 6) includes: a plastic (such as PVC) adapter 561 having a male-threaded portion 562 formed on a bottom of the adapter 561 to be secured into a female threaded hole 50 formed in a top end of the central shaft 5 and having a female-threaded opening 563 formed in a top surface of the adapter 561; and a metal (such as copper) plug 564 having a screw portion 565 formed on a bottom of the plug 564 to be engaged in the opening 563 of the adapter 561, thereby firmly fastening the top cap member 56 on a top of the central shaft 5 for preventing loosening and separation of the cap member 56 from the shaft 5.

Another preferred top cap member (FIGS. 6*a*, 6*b*) includes: an adapter 561*a* having a m ale-threaded portion 562 formed on a bottom of the adapter 561 to be engaged with a female-threaded hole 50 formed in a top end of the shaft 5 and having a central hole 563*a* formed through the adapter 561*a*; and a plastic plug 564*a* having a bottom plug portion 565*a* formed with a bottom recess 566 in a bottom of the plug portion 565*a*; whereby upon engagement of tie plug portion 565*a* with a bottom portion of the adapter 561*a* through the central hole 563*a* of the adapter, the p lug 564*a* will be pushed into the adapter 561*a* to be firmly secured on the top of the shaft 5.

As shown in FIG. 9, the outer portion 11 of the top rib o is formed with a pair of crimping lugs 111 for cladding the inner portion 21 of the outer rib 2, and the outer portion 11 of the top rib 1 is pivotally connected with the stretcher rib 4 by a pivot 12.

Figure 10:
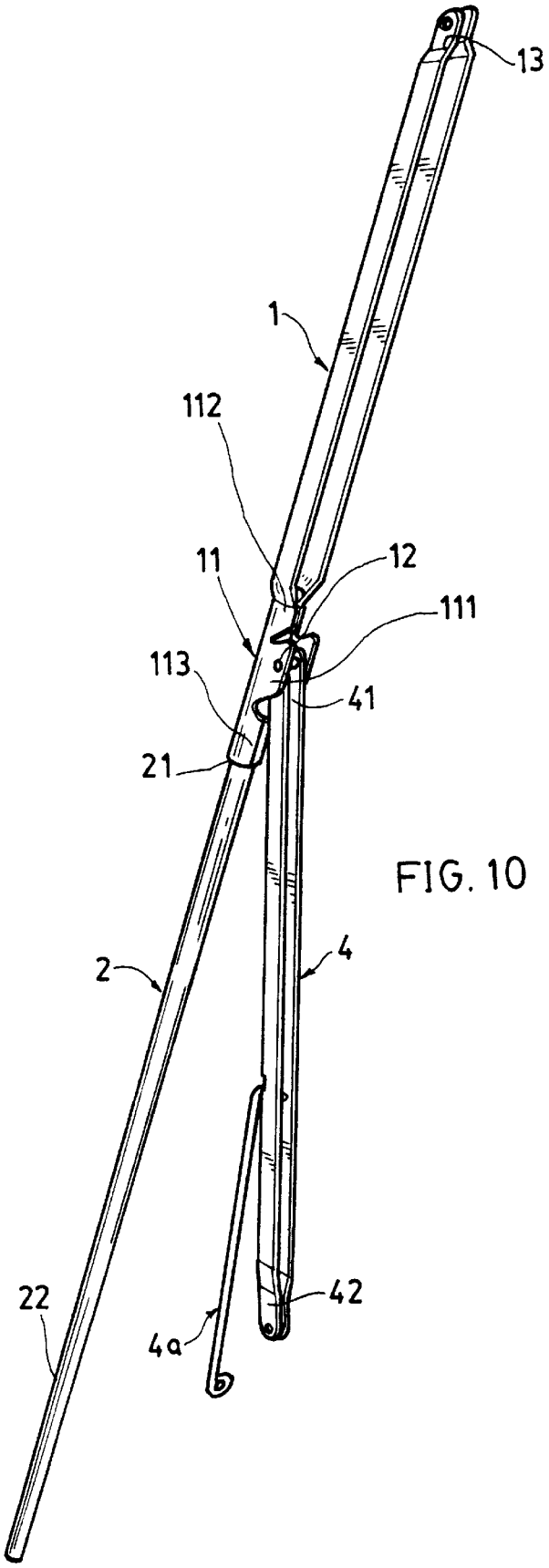
FIG. 10 shows sitll another preferred embodiment of the rib assembly.

As shown in FIG. 10, the outer portion i5 of the top rib 1 is formed with a pair of protrusion lugs 111 for pivotally connecting the stretcher rib 4 by a pivot 12, and formed with two pairs of crimping lugs 112, 113 disposed on opposite sides of the protrusion lugs 111 for respectively cladding the inner end portion 21 of the outer rib 2.

Figures 11, 12:
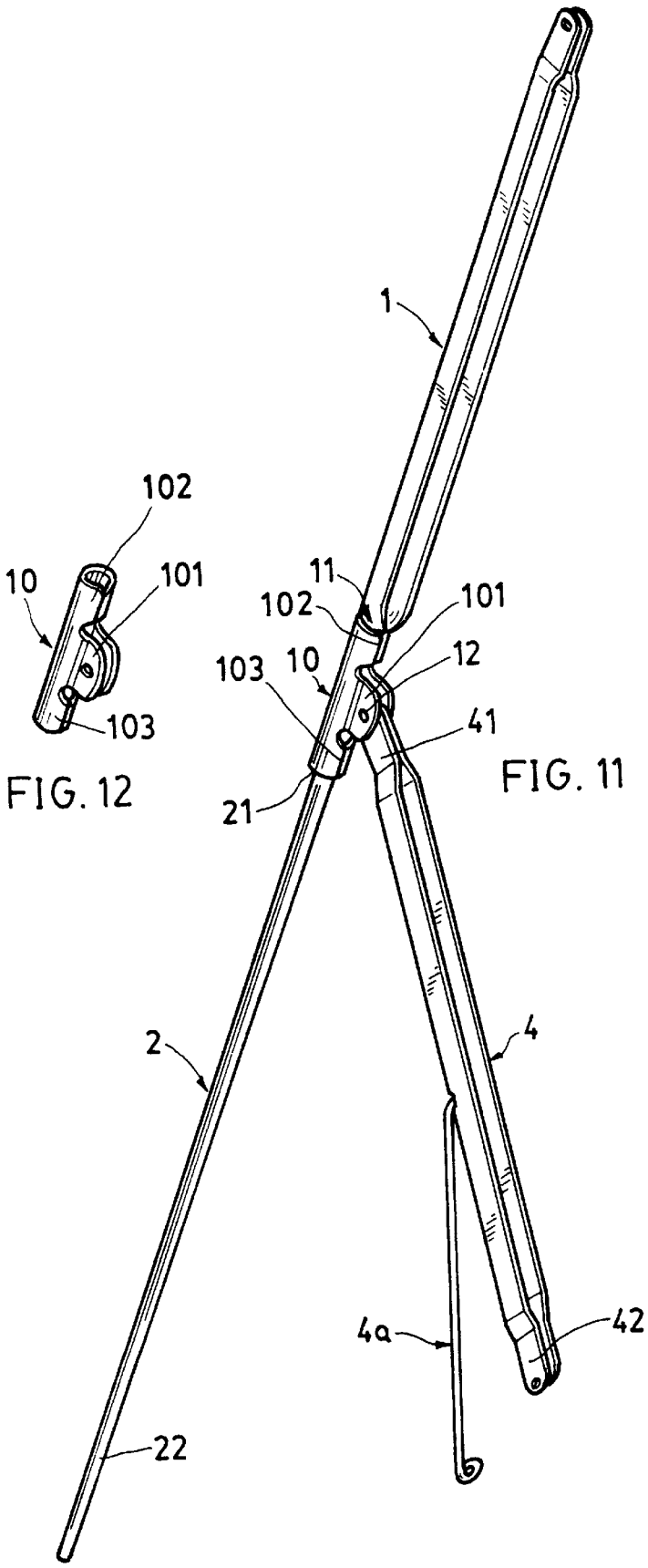
FIG. 11 shows further preferred embodiment of the present invention.
FIG. 12 is a perspective view of the joint member of the present invention as shown in FIG. 11.

As shown in FIGS. 11, 12, the top rib 1 has its outer portion 11 cladding or surrounding the inner portion 21 of the outer rib 2, and a joint member 10 disposed around a junction between the top rib i and the outer rib 2. The joint member 10 includes: a pair of protrusion Lugs 101 for pivotally connecting an outer rib portion 41 of the stretcher rib 4 by a pivot 12, two pairs of crimping lugs 102, 103 disposed on opposite sides of the protrusion lugs 101 for cladding the outer portion 11 of the top rib 1 in which the inner portion 21 of the outer rib 2 has been clad in the outer portion 11 of the top rib 1, and a plurality of prongs, teeth or protrusions (not shown) pressed inwardly from the joint member 10 into the outer portion 11 of the top rib 1 and the inner portion 21 of the outer rib 2 for firmly connecting the joint member 10, the outer rib 2, and the top rib 1 all together.

Figure 14:
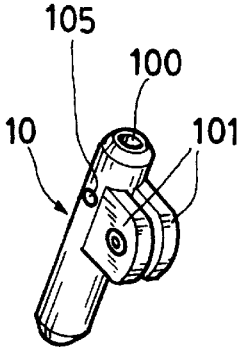
FIG. 14 is a perspective view of the joint member as shown in FIG. 13.
Figure 13:
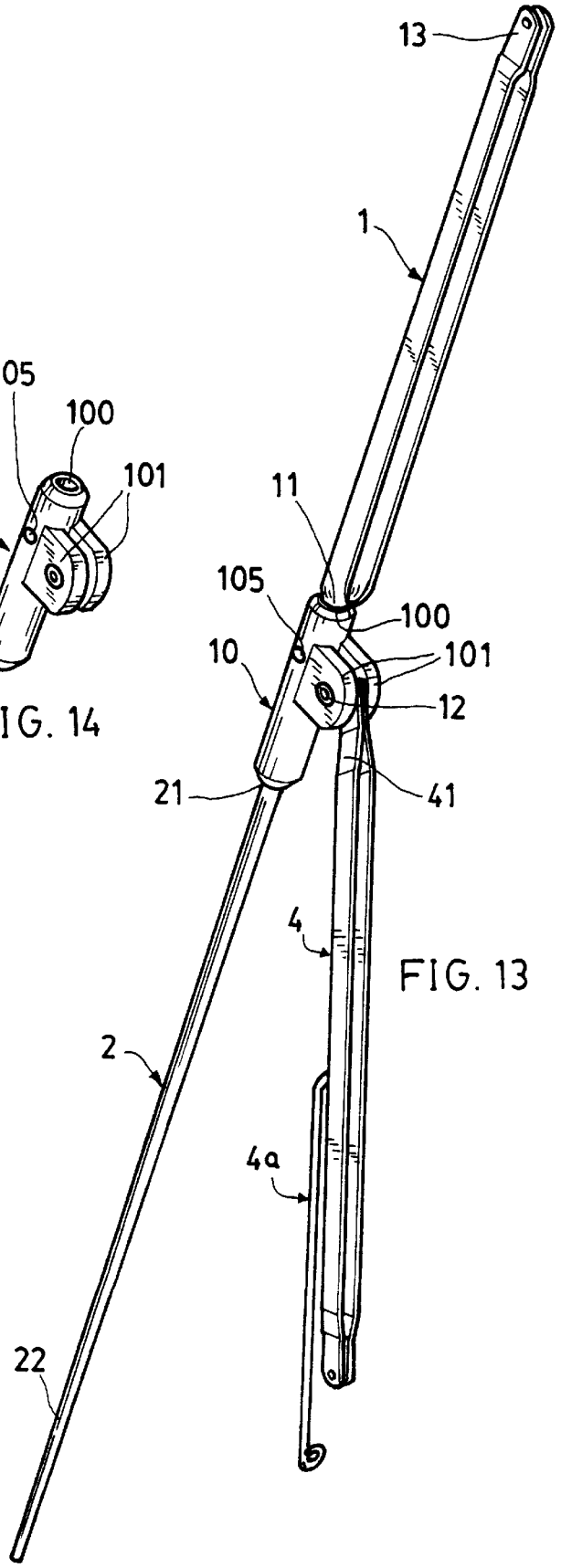
FIG. 13 shows still further preferred embodiment of the present invention.

As shown in FIGS. 13, 14, the outer portion 11 of the top rib 1, after cladding the inner portion 21 of the outer rib 2 within the outer portion 11 of the top rib 1, is then clad by a Joint member 10. The joint member 10 includes: a central through hole 100 for inserting the outer portion 11 of the top rib 1 into the central through hole 100, a pin or nail 105 transversely passing through the joint member 10, the outer portion 11 of the top rib 1 and the inner portion 21 of the outer rib 2 for joining the joint member 10 together with the top rib 1 and the outer rib 2, and a pair of protrusion lugs 101 protruding downwardly from the joint member 10 for pivotally connecting the stretcher rib 4 by a pivot 12.

The middle runner 52 may also be assembled from a ferrule 52i and a sleeve member 522, made of materials having good mechanical strength, for preventing deformation of the runner 52 (FIGS. 6*c*, 6*d*).

The present invention is superior to a conventional automatic umbrella with the following advantages:

1. The rib assembly is light in weight but still having a good mechanical property for resisting deformation, bending and twisting of the ribs.
2. The tensioning spring 55 is flattened and minimized in dimension for making a slim umbrella.
3. The top cap member 56 is firmly fixed on a top of the central shaft 5 for preventing loosening or loss of the cap from the umbrella top.
4. The ball tips 3 are firmly fixed to the tapered outer portions 22 of outer ribs 2 so that each ball tip 3 may be shortened to be closer to the central shaft when the umbrella is closed for making a compact umbrella.

The present invention may be modified without departing from the spirit and scope of this invention. The auxiliary stretcher rib 4*a* as shown in FIG. 1 may also be substituted with a fine metal rib, not limited in this invention.

What is claimed is:

1. An automatic umbrella comprising:

a reinforced umbrella rib assembly including at least a top rib (1) pivotally connected to an upper notch (51) of a central shaft (5) and connected with a stretcher rib (4), each said top rib (1) and each said stretcher rib (4) having a cross section of U shape and made of materials selected from aluminum alloy, titanium alloy, and materials light in weight, and mechanically processed, manufactured and integrally formed with a groove longitudinally recessed in each said top rib (1) and each said stretcher rib (4), an outer rib (2') secured to an outer portion (11) of each said top rib (1), said stretcher rib (4) pivotally connected between a middle runner (52) slidably held on the central shaft (5) and the top rib (1) adjacent to a junction between the top rib (1) and the outer rib (2) and an auxiliary stretcher rib (4a) pivotally connected between the stretcher rib (4) and a lower runner (53) slidably held on the central shaft (5), with said outer rib (2) and said auxiliary stretcher rib (4*a*) made of composites and plastic materials selected from carbon fiber, fiber-glass reinforced plastic, nylon, mineral-fiber reinforced composites, and engineering plastics having good mechanical strength for resisting bending, deformation and twisting and having good resilience for reinforcing the top rib (1) for forming the umbrella rib assembly with light weight and resilience;

a flattened tensioning spring (55) for opening the umbrella retained between said middle runner (52) and said lower runner (53) having a cross section (551) of rectangular shape of a spring ring of the spring (55) for minimizing the dimension of the shaft (5);

a top cap member (56) including an adapter secured on a top of the central shaft (5) and a plug fixed on a top of the adapter for firmly fastening the top cap member (56) on the top of the central shaft (5);

a plurality of ball tips (3) each formed with a tubular hole (31) in the ball tip (3) to be firmly engageable with an outer end portion (22) of each said outer rib (2) which is gradually tapered outwardly; and said top rib (1) having an outer portion (11) which is bifurcated to be two crimping lugs (111) for cladding an inner portion (21) of the outer rib (2), having a plurality of prongs (112) pressed inwardly from the top rib (1) into the inner portion (21) of the outer rib for firmly connecting the inner portion (21) of the outer rib (2) with the outer portion (11) of the top rib (1).

2. An automatic umbrella according to claim 1, wherein said outer portion (11) of said top rib (1) is formed with a pair of protrusion lugs (110) for pivotally connecting the stretcher rib (4) by a pivot (12);

each said protrusion lug (110) tapered inwardly towards a middle portion of said top rib (1) for forming a reinforcing wing portion (113) between the protrusion lug (110) and the middle portion of the top rib (1), having a bottom extension (114) formed on a bottom of said top rib (1) as bent from one said reinforcing wing portion (113) for cladding an innermost end (211) of the outer rib (2); and said stretcher rib (4) having a pair of lugs (40) formed thereon for pivotally connecting an outer portion of said auxiliary stretcher rib (4*a*).

3. An automatic umbrella comprising:

a reinforced umbrella rib assembly including at least a top rib (1) pivotally connected to an upper notch (51) of a central shaft (5) and connected with a stretcher rib (4), each said top rib (1) and each said stretcher rib (4) having a cross section of U shape and made of materials selected from aluminum alloy, titanium alloy, and materials light in weight, and mechanically processed, manufactured and integrally formed with a groove longitudinally recessed in each said top rib (1) and each said stretcher rib (4), an outer rib (2) secured to an outer portion (11) of each said top rib (1), said stretcher rib (4) pivotally connected between a middle runner (52) slidably held on the central shaft (5) and the top rib (1) adjacent to a junction between the top rib (1) and the outer rib (2) and an auxiliary stretcher rib (4*a*) pivotally connected between the stretcher rib (4) and a lower runner (53) slidably held on the central shaft (5), with said outer rib (2) and said auxiliary stretcher rib (4*a*) made of composites and plastic materials selected from carbon fiber, fiber-glass reinforced plastic, nylon, mineral-fiber reinforced composites, and engineering plastics having good mechanical strength for resisting bending, deformation and twisting and having good resilience for reinforcing the top rib (1) for forming the umbrella rib assembly with light weight and resilience;

a flattened tensioning spring (55) for opening the umbrella retained between said middle runner (52) and said lower runner (53) having a cross section (551) of rectangular shape of a spring ring of the spring (55) for minimizing the dimension of the shaft (5);

a top cap member (56) including an adapter secured on a top of the central shaft (5) and a plug fixed on a top of the adapter for firmly fastening the top cap member (56) on the top of the central shaft (5);

a plurality of ball tips (3) each formed with a tubular hole (31) in the ball tip (3) to be firmly engageable with an outer end portion (22) of each said outer rib (2) which is gradually tapered outwardly; and said top rib (1) having its outer portion (11) cladding the inner portion (21) of the outer rib (2), and a joint member (10) disposed around a junction between the top rib (1) and the outer rib (2), said joint member (10) including: a pair of protrusion lugs (101) for pivotally connecting an outer rib portion (41) of the stretcher rib (4) by a pivot (12), two pairs of crimping lugs (102, 103) disposed on opposite sides of the protrusion lugs (101) for cladding the outer portion (11) of the top rib (1) and the inner portion (21) of the outer rib (2) which has been clad in the outer portion (11) of the top rib (1), and a plurality of prongs pressed inwardly from the joint member (10) into the outer portion (11) of the top rib (1) and the inner portion (21) of the outer rib (2) for joining the joint member (10), the outer rib (2), and the top rib (1).

4. An automatic umbrella comprising:

a reinforced umbrella rib assembly including at least a top rib (1) pivotally connected to an upper notch (51) of a central shaft (5) and connected with a stretcher rib (4), each said top rib (1) and each said stretcher rib (4) having a cross section of U shape and made of materials selected from aluminum alloy, titanium alloy, and materials light in weight, and mechanically processed, manufactured and integrally formed with a groove longitudinally recessed in each said top rib (1) and each said stretcher rib (4), an outer rib (2) secured to an outer portion (11) of each said top rib (1), said stretcher rib (4) pivotally connected between a middle runner (52) slidably held on the central shaft (5) and the top rib (1) adjacent to a junction between the top rib (1) and the outer rib (2) and an auxiliary stretcher rib (4*a*) pivotally connected between the stretcher rib (4) and a lower runner (53) slidably held on the central shaft (5), with said outer rib (2) and said auxiliary stretcher rib (4*a*) made of composites and plastic materials selected from carbon fiber, fiber-glass reinforced plastic, nylon, mineral-fiber fiber reinforced composites, and engineering plastics having good mechanical strength for resisting bending, deformation and twisting and having good resilience for reinforcing the top rib (1) for forming the umbrella rib assembly with light weight and resilience;

a flattened tensioning spring (55) for opening the umbrella retained between said middle runner (52) and said lower runner (53) having a cross section (551) of rectangular shape of a spring ring of the spring (55) for minimizing the dimension of the shaft (5); a top cap member (56) including an adapter secured on a top of the central shaft (5) and a plug fixed on a top of the adapter;

a plurality of ball tips (3) each formed with a tubular hole (31) in the ball tip (3) to be firmly engageable with an outer end portion (22) of each said outer rib (2) which is gradually tapered outwardly; and said outer portion (11) of the top rib (1) having an inner portion (21) of the outer rib (2) clad within the outer portion (11) of the top rib (1), and having a joint member (10) clad on said outer portion (11) of the top rib (1), said joint member (10) including: a central through hole (100) for inserting the outer portion (11) of the top rib (1) into the central through hole (100), a pin (105) transversely passing through the joint member (10), the outer portion (11) of the top rib (1) and the inner portion (21) of the outer rib (2) for joining the joint member (10) together with the top rib (1) and the outer rib (2), and a pair of protrusion lugs (101) protruding downwardly from the joint member (10) for pivotally connecting the stretcher rib (4) by a pivot (12).

5. An automatic umbrella according to claim 1, wherein said top cap member (56) includes: a plastic adapter (561) having a male-threaded portion (562) formed on a bottom of the adapter (561) to be secured into a female threaded hole (50) formed in a top end of the central shaft (5) and having a female-threaded opening (563) Formed in a top surface of the adapter (56i); and a metal plug (564) having a screw portion (565) formed on a bottom of the plug (564), to be engaged in the opening 563) of the adapter (561), thereby firmly fastening the top cap member (56) on the top of the central shaft (5) for preventing loosening and separation of the cap member (56) from the shaft (5).

6. An automatic umbrella according to claim 1, wherein said top cap member (56) includes: an adapter **(561*a*) having a male-threaded portion (562) formed on a bottom of the adapter (561) to be engaged with a female-threaded hole (50) formed in a top end of the shaft (5) and having a central hole (563*a*) formed through the adapter (561*a*); and a plastic plug (564*a*) having a bottom plug portion (565*a*) formed with a bottom recess (566) in a bottom of the portion (565*a*); whereby upon engagement of the plug portion (565*a*) with a bottom portion of the adapter (561*a*) through the central hole (563a) of the adapter, the plug (564*a*) will be pushed into the adapter (561*a*) to be firmly secured on the top of the shaft (5)**.

7. An automatic umbrella according to claim 1, wherein said auxiliary stretcher rib **(4*a*) is a slightly arcuate resilient rib retained between tile lower runner (53) and the stretcher rib (4); whereby upon closing and folding of the rib assembly (2), the auxiliary stretcher rib (4*a*) is straightened to store its resilience to thereby add on the resilience of the flattened tensioning spring (55) jacketed on the shaft (5)** adapted for opening the umbrella.

8. An automatic umbrella according to claim 1, wherein said middle runner (52) includes a ferrule (521) and a sleeve member (522) assembled with each other for forming said middle runner (52).

* * * * *